US006988712B2

(12) United States Patent
Kawasaki et al.

(10) Patent No.: US 6,988,712 B2
(45) Date of Patent: Jan. 24, 2006

(54) SCREW JACK

(75) Inventors: Yasuji Kawasaki, Shizuoka-Pref. (JP); Kohji Kawasaki, Shizuoka-Pref. (JP)

(73) Assignee: Kawasaki Industrial Co., Ltd., Shizuoka-Pref. (JP)

( * ) Notice: Subject to any disclaimer, the term of this patent is extended or adjusted under 35 U.S.C. 154(b) by 15 days.

(21) Appl. No.: 11/028,142

(22) Filed: Jan. 3, 2005

(65) Prior Publication Data

US 2005/0161649 A1 Jul. 28, 2005

(30) Foreign Application Priority Data

Jan. 22, 2004 (JP) ..... 2004-014537

(51) Int. Cl.
*B66F 3/18* (2006.01)

(52) U.S. Cl. ..... 254/103

(58) Field of Classification Search ..... 254/102, 254/103

See application file for complete search history.

(56) References Cited

U.S. PATENT DOCUMENTS

RE19,923 E * 4/1936 Bate ..... 254/103

FOREIGN PATENT DOCUMENTS

JP 3046162 2/1991

* cited by examiner

*Primary Examiner*—Robert C. Watson
(74) *Attorney, Agent, or Firm*—Rodman Rodman

(57) ABSTRACT

A rotatable cylinder, a threaded cylinder and a center threaded rod are sequentially inserted in their mutually threadingly engaged states in the inner side of a guiding inner cylinder part which is vertically disposed at the case body through an inner periphery thread and an outer periphery thread. A large bevel gear disposed at a lower end part of the rotatable cylinder is threadingly engaged with a small bevel gear which is borne by the case body, a thrust bearing having a large inside diameter is sandwiched between the large bevel gear and a bottom plate of the case body, and the center threaded rod is provided at its upper end face part with an engagement part for preventing the rotating motion of the center threaded rod when engaged with a jack attachment part of a body to be lifted up such as an automobile. A surrounding cover deformable only in accordance with the motion of upward extension and downward contraction of the threaded cylinder and the center threaded rod is interposed between the upper end part of the center threaded rod and the case body. Moreover, The threaded cylinder and the center threaded rod are such dimensioned in length that in their downward contraction states, the lower end parts are passed through the inside diameter of the thrust bearing having a large inside diameter and abutted with the upper surface of the bottom plate of the case body.

4 Claims, 2 Drawing Sheets

SCREW JACK

BACKGROUND OF THE INVENTION

1. Field of the Invention

This invention relate's to a portable screw-type jack (screw jack) which is a tool for lifting up a heavy load and which is chiefly used for attaching/detaching a tire in a repairing work for a flat tire of automobiles, etc.

2. Related Art

The conventional screw jack is called as a three-stage type screw jack which comprises, as disclosed in Japanese Utility Model Publication No. 3046162, a jack case main body with a cylinder body part vertically disposed at a central area thereof, a threaded shaft, an auxiliary threaded cylinder and an inner cylinder which are all sequentially inserted in the cylinder body part such that the threaded shaft occupies the center. A large bevel gear is placed on a thrust bearing which is disposed on a bed part of the jack case main body, and a threaded shaft with an outer periphery thread is vertically arranged and fixed to the center of the large bevel gear. The auxiliary threaded cylinder and the inner cylinder are arranged on this large bevel gear. The auxiliary threaded cylinder with an inner periphery thread and outer periphery thread, which is to be engaged with the threaded shaft, is disposed at the outer side of the threaded shaft. The inner cylinder with an inner periphery thread, which is to be engaged with the outer periphery thread of this auxiliary threaded cylinder, is disposed at the outer side of the auxiliary threaded cylinder. This inner cylinder is upwardly and downwardly movably slidingly fitted to the inside of the cylinder body part of the jack case main body through the outer cylinder covering the outer side of this inner cylinder. A rotation preventing mechanism provided with a vertical groove and a projection upwardly and downwardly movably sliding fitted to the vertical groove is disposed between every adjacent two of the inner cylinder, the outer cylinder and the cylinder body part of the jack case main body.

By rotating a small bevel gear engaged with the large bevel gear borne by the jack case main body from the downward contraction state in which the auxiliary threaded cylinder and the inner cylinder are receiving in the cylinder body of the jack case main body, the threaded shaft is rotated through the large bevel gear. In accordance with the rotation of the threaded shaft, the auxiliary threaded cylinder and the inner cylinder are moved upwardly and extended. Moreover, in accordance with the rotation of the threaded shaft and the auxiliary threaded cylinder, the inner cylinder and the rotation preventing outer cylinder are moved upward and extended to lift up the body of an automobile with which a receiving fitting at the upper end of the inner cylinder is abutted.

In the above-mentioned conventional screw jack, an auxiliary threaded cylinder and an inner cylinder are sequentially inserted in the cylinder main body of a jack case main body about a threaded shaft in a triplet state. Moreover, a rotation preventing outer cylinder is disposed at the outer side of the inner cylinder, and a rotation preventing mechanism is disposed each between the inner cylinder and the outer cylinder and between the outer cylinder and the cylinder main body. Accordingly, in addition to the auxiliary threaded cylinder and the inner cylinder which are moved upward and downward for lifting up a heavy load such as an automobile, a rotation preventing outer cylinder and a rotation preventing mechanism are needed for preventing the rotation of the auxiliary threaded cylinder and the inner cylinder at the time of upward and downward movement.

Thus, the number of component parts is increased and a complicated structure is inevitably required. Moreover, since the auxiliary threaded cylinder and the inner cylinder are placed on the large bevel gear fixed to a lower end of the threaded shaft and adapted to rotate the threaded shaft, the auxiliary threaded shaft and the inner cylinder are reduced in length which results in difficulty in upward and downward (extension and contraction) stroke.

SUMMARY OF THE INVENTION

It is an object of the present invention to cope with a complicated rotation-preventing mechanism with a simple means and to provide a screw jack in which the upward and downward stroke is high.

A screw jack according to the present invention comprises a case body, a guiding inner cylinder part vertically disposed at the case body, a rotatable cylinder, a threaded cylinder and a center threaded rod which are sequentially inserted in the inner side of the guiding cylinder part, the rotatable cylinder including an inner periphery thread and an outwardly facing flange-like large bevel gear disposed at a lower end part of the rotatable cylinder, the large bevel gear being engaged with a small bevel gear borne by the case body, a thrust bearing being sandwiched between the large bevel gear and a bottom plate of the case body, the threaded cylinder being provided with an outer periphery thread which is to be engaged with the inner periphery thread of the rotatable cylinder, and an inner periphery thread, the center threaded rod being provided with an outer periphery thread which is to be engaged with the inner periphery thread of the threaded cylinder, an upper end surface of the center threaded rod being provided with an engagement part which is to be engaged with a jack attachment part of a body to be lifted up such as an automobile, the small bevel gear being rotationally driven from outside to rotate the rotatable cylinder through the large bevel gear, thereby causing the threaded cylinder and the center threaded rod, which are mutually threadingly engaged and transmitted, to be extended upward and contracted downward.

The engagement part of the center threaded rod is such constructed that when the engagement part is in engagement with the jack attachment part of the body to be lifted up such as an automobile, the center threaded rod provided with the engagement part is prevented from being rotationally driven.

A surrounding cover deformable only in accordance with motion of upward extension and downward contraction of the threaded cylinder and the center threaded rod is sandwiched between the case body and the upper end part of the center threaded rod.

The inside diameter of the thrust bearing is equal to or more than the outside diameter of the threaded cylinder, and the threaded cylinder and the center threaded rod are such dimensioned in length that in the downward contraction state, lower end parts thereof are passed through the inside diameter of the thrust bearing and abutted with an upper surface of the bottom plate of the case body.

BEST MODE FOR CARRYING OUT THE INVENTION

Figure 1:
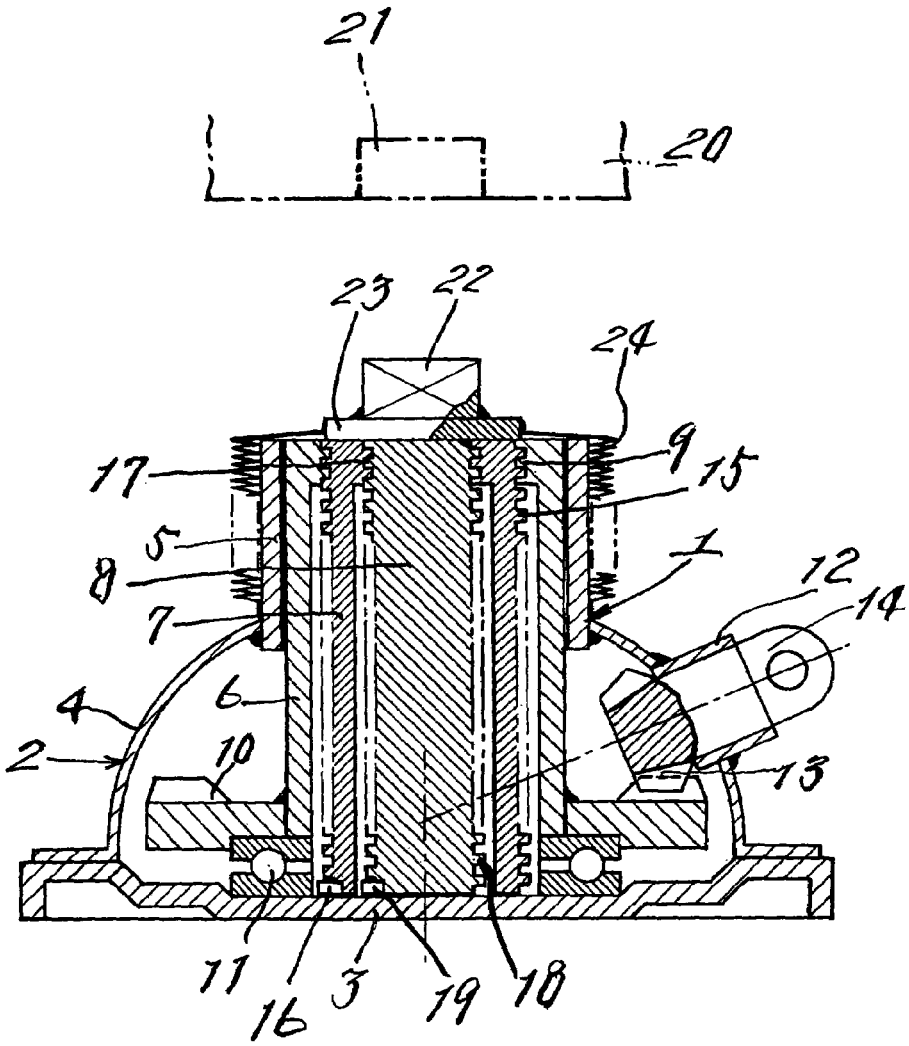
FIG. 1 is a vertical sectional side view of a screw jack which is in a downward contraction state.

In the drawings, reference numeral 1 denotes a screw jack. This screw jack 1 has a case body 2 which comprises a bottom plate 3 serving as an installation base, a dome-like cover 4 fixed to the bottom plate 3 in such a manner as to cover the plate 3, and a guiding cylinder part 5 vertical installed at a central position of the dome-like cover 4. As shown in the utmost downward contraction state of FIG. 1, a rotatable cylinder 6 capable of rotating along the inner peripheral surface of a guiding cylinder part 5 is disposed at the inner side of the guiding cylinder part 5. A threaded cylinder 7 is inserted in the inner side of the rotatable cylinder 6, and a center threaded rod 7 is inserted in the inner side of the rotatable cylinder 6, respectively.

A female thread (hereinafter referred to as the "inner peripheral thread") 9 is disposed at an upper end part of the inner peripheral surface of the rotatable cylinder 6, and a large bevel gear 10 with the engagement teeth formed at an upper surface thereof is integrally fixed to the outer periphery of the lower end part in the form of an outwardly facing flange. A thrust bearing 11 having a large inside diameter generally equal to the diameter of the inner peripheral surface of the rotatable cylinder 6 is sandwiched between a lower surface of the large bevel gear 10 and the upper surface of the bottom plate 3 in the case body 2. Owing to this arrangement, the rotatable cylinder 6 and the large bevel gear 10 are rotatable along the inner peripheral surface of the guiding cylinder part 5 in the case body 2.

A small gear 13, which is rotatably carried on a bearing part 12 disposed at the dome-like cover 4 on a slantwise line extending from the center of the large bevel gear 10, is engaged with the large bevel gear 10. A joint part 14 for locking a handle (not shown) for rotationally driving the small gear 13 from outside is disposed at a shaft end part of the small bevel gear 13.

The threaded cylinder 7 is such dimensioned in length that its lower end is abutted with the upper surface of the bottom plate 3 in the case body 2. A male thread (hereinafter referred to as the "outer periphery thread") 15, which is to be threadingly engaged with the inner periphery thread 9 formed on the upper end part of the inner peripheral surface of the rotatable cylinder 6, is formed on the outer peripheral surface of the threaded cylinder 7 from its upper end to its lower end. A stopper pin 16, which is to be abutted with the lower end edge part in the inner periphery thread 9 of the rotatable cylinder 6, is projected from the lower end part of the threaded cylinder 7.

The center threaded rod 8 has such is such dimensioned in length that its lower end is abutted with the upper surface of the bottom plate 3 in the case body 2. An outer periphery thread 18, which is to be threadingly engaged with the inner periphery thread 9 formed on the upper end part of the inner peripheral surface of the threaded cylinder 7, is formed on the outer peripheral surface of the center threaded rod 8 from its upper end to its lower end. A stopper pin 16, which is to be abutted with the lower end edge part in the inner periphery thread 17 of the threaded cylinder 7, is projected from the lower end part of the center threaded rod 8. An engagement part 22, which is to be engaged with a jack attachment part 21 of a heavy load (hereinafter referred to as the "body to be lifted up") 20 such as an automobile is disposed at the upper end surface part of the center threaded rod 8 through a flange element 23.

Figure 2:
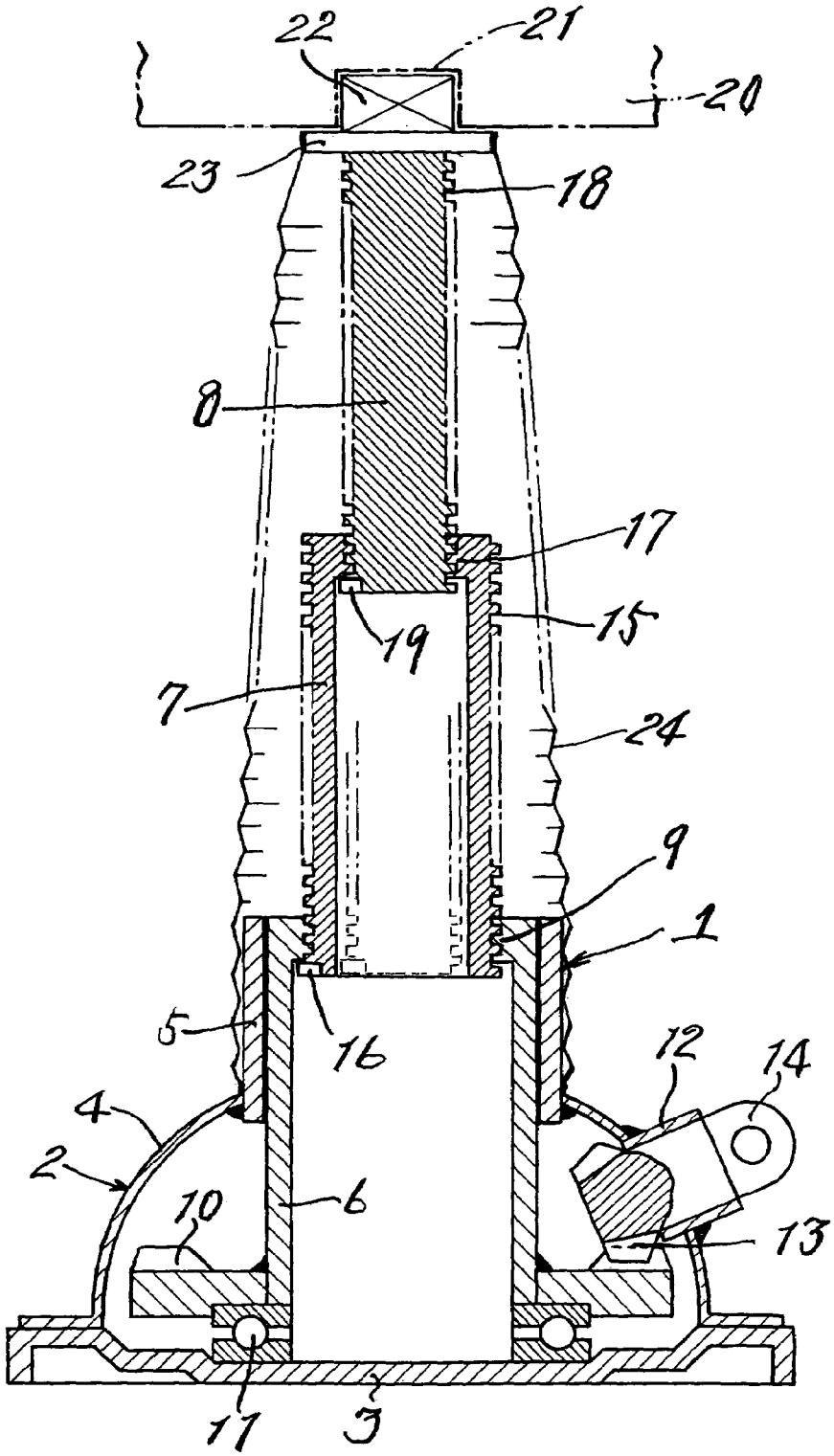
FIG. 2 is a vertical sectional side view of a screw jack which is in an upward extension state.

The jack attachment part 21 of the body 20 to be lifted up and the engagement part 22 of the screw jack preferably comprise, as shown in FIGS. 1 and 2, a square hole on the attachment part 21 side and a square projection on the engagement part 22 side which square projection is to be fitted to the square hole. The square projection may be on the attachment part 21 side, and the square hole to be fitted to the square projection may be on the engagement part 22 side. It is also preferably accepted that the engagement part 22 side is formed of a U-shaped steel capable of sandwiching the structural material of the attachment part 21 side. In this preferred construction, it is essential that in the fitting condition between the attachment part 21 side and the engagement part 22 side, the center threaded rod 8 with the engagement part 22 provided thereon should be prevented from rotating.

A surrounding cover 24 which is deformed only in accordance with the extending and contracting motion of the screw jack 1 such as a cylindrical bellows body and hardly torsionally deformed is interposed between the outer peripheral part of the guiding cylinder part in the case body 2 and the upper end part of the center threaded rod 8 or the flange element 3.

In the screw jack 1, by externally rotationally driving operation given to the handle locked to the joint part 16 of the small bevel gear 13, the rotatable cylinder 6 is rotated through the small bevel gear 13 and the large bevel gear 10. Then, in accordance with the rotation of the rotatable cylinder 6 through the small bevel gear 13 and the large bevel gear 10, the threaded cylinder 7 including the outer periphery thread 15 which is engaged with the inner periphery thread 9 of the rotatable cylinder 6 is also rotated. The rotation of the rotatable cylinder 6 and the threaded cylinder 7 causes a threading engagement and transmission between the inner periphery thread 17 of the threaded cylinder 7 and the outer periphery thread 18 of the center threaded rod 8, thereby upwardly moving and extending the center threaded rod 8. In accordance with this upward extending movement, a stopper pin 19 of the center threaded rod 8 is abutted with a lower end edge part in the inner periphery thread 17 of the threaded cylinder 7, so that the center threaded rod 8 and the threaded cylinder 7 are integrated.

When the rotatable cylinder 6 is further rotated, the threading engagement and transmission between the inner periphery cylinder 7 and the center threaded rod 8 causes the center threaded rod 8 to make the upward extension movement. In accordance with this upward extension movement, the stopper pin 16 of this threaded cylinder 7 is abutted with the lower end edge part in the inner periphery thread 9 of the rotatable cylinder 6, so that the center threaded rod 8 is brought into the utmost upward extension state (FIG. 2).

Then, in accordance with the upward extension movement of the threaded cylinder 7 and the center threaded rod 8, the surrounding cover 24, which is interposed between the case body 2 (guiding cylinder part 5) and the upper end part (flange element 23) of the center threaded rod 8, is extended to lift up the body 20 to be lifted up such as an automobile through the engagement part 22 engaged with the jack attachment part 21 of the body 20 to be lifted up.

In order to move down the body 20 to be lifted up, the handle is simply rotated reversely. In accordance with the downward retreating movement of the center threaded rod 8, the flange element 23 is abutted with the upper end face of the threaded cylinder 7. Then, the center threaded rod 8 and the threaded cylinder 7 are moved downward and retreated so as to be abutted with the upper surface of the bottom plate 3 of the case body 2, thereby achieving the utmost downward contraction state (FIG. 1).

Since the surrounding cover 24 is extended and contracted while preventing the rotation of the threaded cylinder 7 and the center threaded rod 8 in accordance with the upward and downward extending and contracting motion owing to its such characteristics that it is deformed only by extending and contracting motion, it conducts a temporary rotation preventing action until the rotation is surely prevented as a result of the engagement part 22 of the center threaded rod 8 with the jack attachment part 21 of the body 20 to be lifted up.

In the screw jack 1 according to the present invention, as the conventional rotation preventing means at the time of upward and downward extension and contraction movement, the conventionally required complicated mechanism such as a rotation preventing cylinder which is moved upward and downward in accordance with the upward and downward movement of the upwardly and downwardly movable cylinder and the threaded shaft, a vertical groove and the like, is no more required. Instead, the engagement part 22 of the screw jack 1 is engaged with the jack attachment part 21 of the body 20 to be lifted up, so that the rotation can be prevented. At the time of upward and downward extending and contracting movement wherein the engagement part 22 is not in engagement with the jack attachment part 21, the surrounding cover 24 such as a bellows, which is extendingly and contractingly deformed only in accordance with the upward and downward movement is employed to conduct a temporary rotation preventing action with a simple construction. Accordingly, the number of manufacturing parts of the screw jack can be reduced and the construction can be simplified. Thus, the cost down can be achieved and the screw jack according to the present invention is reduced in weight so as to be easy to carry with. Moreover, since the inside diameter of the thrust bearing 11 for bearing the large bevel gear 10 and the rotatable cylinder 6 is set to be larger than the outside diameter of the threaded cylinder 7, the threaded cylinder 7 and the center threaded rod 8 can be increased in length at least by a portion equal to the thickness of the large bevel gear 10 compared with the conventional one. In case the utmost contraction length of the jack is presumed as constant compared with the conventional one, the screw jack according to the present invention can offer a high stroke function.

What is clamed is:

1. A screw jack comprising a case body, a guiding inner cylinder part vertically disposed at said case body, a rotatable cylinder, a threaded cylinder and a center threaded rod which are sequentially inserted in the inner side of said guiding cylinder part, said rotatable cylinder including an inner periphery thread and an outwardly facing flange-like large bevel gear disposed at a lower end part of said rotatable cylinder, said large bevel gear being engaged with a small bevel gear borne by said case body, a thrust bearing being sandwiched between said large bevel gear and a bottom plate of said case body, said threaded cylinder being provided with an outer periphery thread which is to be engaged with said inner periphery thread of said rotatable cylinder, and an inner periphery thread, said center threaded rod being provided with an outer periphery thread which is to be engaged with said inner periphery thread of said threaded cylinder, an upper end surface of said center threaded rod being provided with an engagement part which is to be engaged with a jack attachment part of a body to be lifted up such as an automobile, said small bevel gear being rotationally driven from outside to rotate said rotatable cylinder through said large bevel gear, thereby causing said threaded cylinder and said center threaded rod, which are mutually threadingly engaged and transmitted, to be extended upward and contracted downward and wherein said engagement part of said center threaded rod is constructed such that when said engagement part is in engagement with said jack attachment part of said body to be lifted up such as an automobile, said center threaded rod provided with said engagement part is prevented from being rotationally driven.

2. A screw jack according to claim 1, wherein a surrounding cover deformable only in accordance with motion of upward extension and downward contraction of said threaded cylinder and said center threaded rod is interposed between said case body and the upper end part of said center threaded rod.

3. A screw jack according to claim 2, wherein the inside diameter of said thrust bearing is equal to or more than the outside diameter of said threaded cylinder, and said threaded cylinder and said center threaded rod are dimensioned in length such that in the downward contraction state, lower end parts thereof are passed through the inside diameter of said thrust bearing and abutted with an upper surface of said bottom plate of said case body.

4. A screw jack according to claim 1, wherein the inside diameter of said thrust bearing is equal to or more than the outside diameter of said threaded cylinder, and said threaded cylinder and said center threaded rod are dimensioned in length such that in the downward contraction state, lower end parts thereof are passed through the inside diameter of said thrust bearing and abutted with an upper surface of said bottom plate of said case body.

* * * * *